US006502600B2

(12) United States Patent
Ennemark et al.

(10) Patent No.: US 6,502,600 B2
(45) Date of Patent: Jan. 7, 2003

(54) HYDRAULIC LINE CONNECTION

(75) Inventors: Poul Ennemark, Sønderborg (DK); Søren Zaremba, Nordborg (DK)

(73) Assignee: Sauer-Danfoss Holding A/S, Nordborg (DK)

( * ) Notice: Subject to any disclaimer, the term of this patent is extended or adjusted under 35 U.S.C. 154(b) by 0 days.

(21) Appl. No.: 09/991,861

(22) Filed: Nov. 19, 2001

(65) Prior Publication Data

US 2002/0036016 A1 Mar. 28, 2002

Related U.S. Application Data

(63) Continuation of application No. PCT/DK00/00260, filed on May 15, 2000.

(30) Foreign Application Priority Data

May 19, 1999 (DE) ..... 199 22 866

(51) Int. Cl.[7] ..... F15B 13/02
(52) U.S. Cl. ..... 137/595; 91/432; 137/596.12
(58) Field of Search ..... 91/432; 137/595, 137/596.12

(56) References Cited

U.S. PATENT DOCUMENTS

| | | | | |
|---|---|---|---|---|
| 4,172,582 | A | 10/1979 | Bobnar | 91/420 |
| 4,244,275 | A | 1/1981 | Smilges | 91/420 |
| 4,953,592 | A | 9/1990 | Takahashi et al. | 91/432 |
| 5,263,400 | A | 11/1993 | Huesser | 91/420 |

FOREIGN PATENT DOCUMENTS

| | | |
|---|---|---|
| DE | 2036547 | 1/1972 |
| DE | 38 16 987 | 11/1989 |
| RU | 2014523 | 6/1994 |

OTHER PUBLICATIONS

International Search Report for PCT/DK00/00260.

*Primary Examiner*—Gerald A. Michalsky
(74) *Attorney, Agent, or Firm*—Altera Law Group, LLC

(57) ABSTRACT

The invention concerns a hydraulic line connection with a supply connection (2) having a pressure line and a return line, each ending at a connection valve (4,5), and with a safety valve (8) in a line between the pressure line and a consumer (1), said safety valve having a valve element (9), whose one side is acted upon by the pressure at the pressure connection (P) with the purpose of opening. The aim is to safely provide a connection of this kind in a simple way. For this purpose the other side of the valve element (9) is directly connected with the return line.

9 Claims, 1 Drawing Sheet

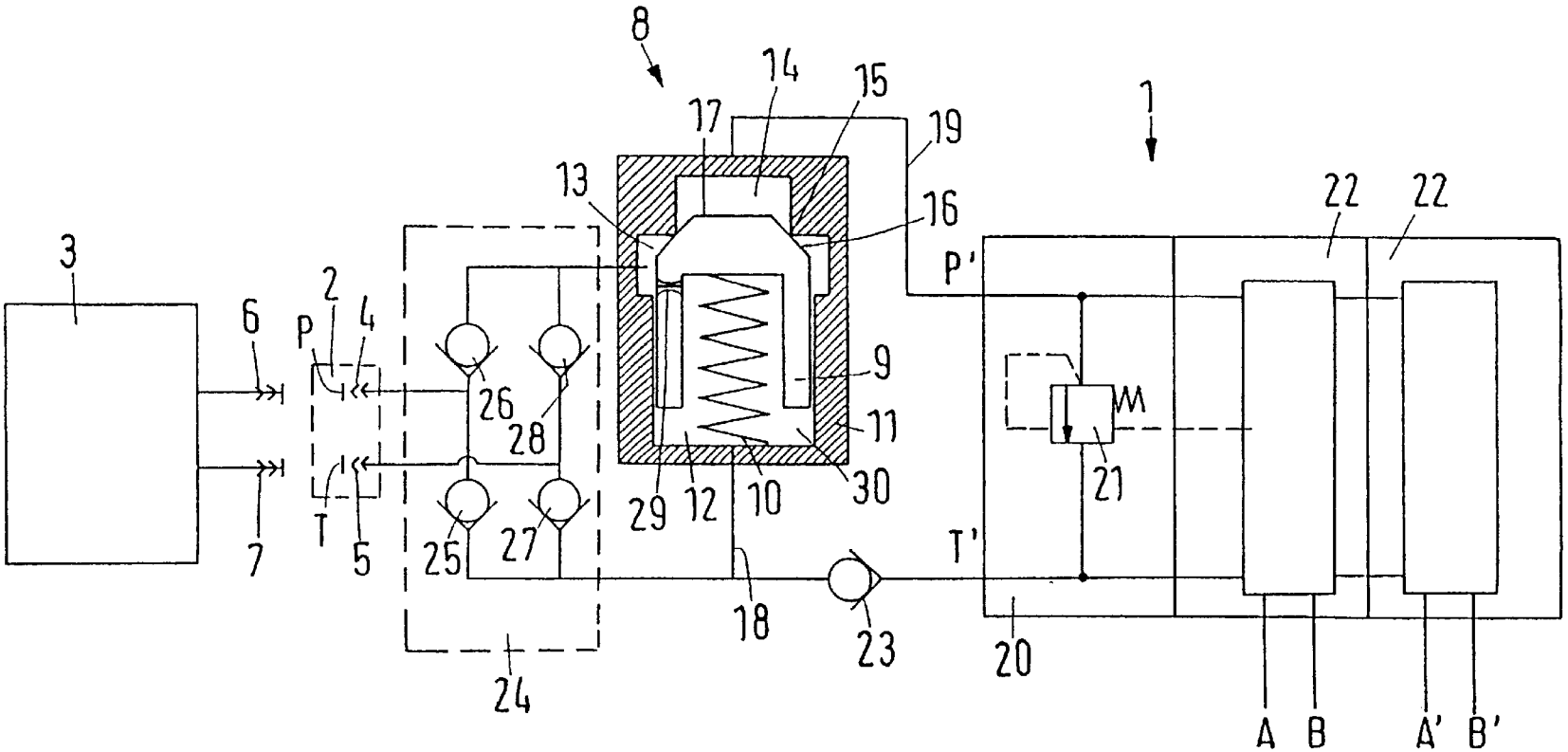
1
22
22
B'
A'
B
A
21
20
P'
T'
19
16
15
14
17
8
9
11
30
10
12
29
13
23
18
28
26
27
25
24
4
5
2
P
T
6
7
3

HYDRAULIC LINE CONNECTION

This application is a continuation of international application serial No. PCT/DK00/00260, filed May 15, 2000.

BACKGROUND OF THE INVENTION

1. Field of the Invention

The invention concerns a hydraulic line connection with a supply connection having a pressure line and a return line, each ending at a connection valve, and with a safety valve in a line between the pressure line and a consumer, said safety valve having a valve element, whose one side is acted upon by the pressure at the pressure connection with the purpose of opening.

2. Description of the Related Art

A hydraulic line connection of this kind is, for example, used when a hydraulic auxiliary equipment must be detachably connected with the hydraulic pressure source. An example of this is farming machinery, which can be connected with the hydraulic system of a tractor. As the tractor uses different working machines in dependence of the task to be solved, such a hydraulic line connection, which is usually made as a snap connection, is required.

Until now, snap connections with connection valves have been used for this kind of hydraulic line connections. The connection valves close the line, when the line connection is separated. This usually happens by pulling a connection plug out of a connection socket or vice versa. Thus, hydraulic fluid is prevented from escaping from the system.

This embodiment has, however, a disadvantage. When, for example, the pressure line is connected correctly, so that the corresponding connection valve here opens, however, the connection valve on the return line does not open, as the return line is not, or is not correctly, connected with the tractor, the pressure will be built up of the pressure connection in the working machine. In unfavourable cases, this can lead to an overload, and even to a damaging of hydraulic elements in the working machine. For example, proportional valves may be damaged.

To reduce this problem, DE 38 16 987 C1 discloses the arrangement of a safety valve in the line connection. This valve has a slide, which, in its resting position, cuts the connection between the pump connection and the working machine, while creating a connection to the tank instead. In the working position, however, a connection between the pump line and the working machine is enabled. From one front side this slide is acted upon by the pressure in the pressure line, from the other front side by the same pressure and additionally by the force of a spring. To be able to move the slide in its working position, it is necessary to mechanically open a non-return valve, which is arranged between this front side and the tank line. For this purpose, the snap connection is used, with which the tank line connects the working machine with the tractor.

A solution of this kind is relatively expensive. It requires a relatively accurate production, to make sure that the non-return valve opens and closes reliably. The mechanical elements may wear off, which may influence the function safety of the safety valve.

SUMMARY OF THE INVENTION

The invention is based on the task of providing a simple production of a hydraulic line connection.

In connection with a hydraulic line connection as described in the introduction, this task is solved in that the other side of the valve element is directly connected with the return line.

With this embodiment, initially the pressure of the pressure line acts upon both sides of the valve element. In the closing direction, a spring is also acting. Somehow, for example via the consumer, the pressure on the closing side comes from the pressure line into the return line, so that firstly the valve element is closed by the effect of the spring and remains in this position. To open, however, it is only necessary to reduce the pressure in the return line. Such a reduction also appears automatically, when the connection valve of the return line is opened. However, this is only the case, when the corresponding connection is connected correctly. Thus, the operation of an additional element is saved. Nevertheless, it is ensured that the pressure from the pressure line can only act upon the consumer, when the return line is correctly connected, that is, a connection from a pressure sink, for example a tank, has been established. In the present case, the term "directly" merely means that a pressure reduction at the connection valve can without problems propagate to the other side of the valve element through the return line. Thus it is indeed permissible, for example, to mount non-return valves in the return line, which open away from the valve element. Such valves do not influence the function.

Preferably, a throttle is provided between the pressure and the return line. Thus, a defined path for the pressure from the pressure line to the return line is created. Thus, the consumer is safely protected in all cases. When the pressure line is connected, the safety valve closes until the pressure in the tank line decreases.

Preferably, the throttle is arranged in the valve element. This permits a very simple embodiment of the safety valve.

It is preferred that the throttle is closed in the opening position of the valve element. This prevents a leakage between the pressure connection and the return line. Here the particular advantage of the placing in the valve element appears. When the valve element is opened, the change of its position enables it to close the throttle simultaneously.

Preferably, the valve element is made in the shape of a slide. This is a very simple embodiment. The slide can simply be moved back and forth. In its closing position it can, for example, with an area near the front side, bear on an edge, which then forms the desired sealing zone.

Preferably, the surface of the valve element, upon which the pressure acts in the opening direction, expands on opening the valve. This is, for example, reached in that the slide in the area of the end, in which the pressure connection ends, has a circumferentially bevelled edge. This edge then forms a surface, with which the slide bears on a housing edge, which forms a valve seat. As long as the valve element is closed, only a relatively small pressure acts in the opening direction, so that the pressure in the closing direction can be kept at a limited level. When the pressure in the closing direction is limited, however, it can also be reduced faster, so that the reaction time of the valve can be kept relatively small. As soon as the slide has made a small opening movement, the pressure reaches its whole front side and accordingly acts upon the slide in the opening direction. A slight increase in the pressure in the closing direction, which often appears, is then insignificant.

Advantageously, the consumer produces a counter pressure, which is larger than the pressure required to open the safety valve. Thus, the safety valve remains open after the first opening, until the hydraulic connection is released or the pressure in the pressure line drops, for example, when the pump is turned off.

Preferably, the consumer has an inlet module, which produces the counter pressure. Otherwise, the consumer can be relieved of this task.

In a preferred embodiment it is provided that the consumer connection has a valve bridge, which is formed by two pairs of non-return valves, opening in the same direction and being arranged in series between the pressure line and the return line, the middle outlets of each pair being connected with a connection valve. This valve bridge is comparable with an electrical rectifier, which is made as a "Wheatstone" bridge. The valve bridge protects against an exchange of the two connection valves, that is, no harm will be done, when the connection valve belonging to the pressure line is connected with the tank line and vice versa.

BRIEF DESCRIPTION OF THE DRAWINGS

In the following the invention is described on the basis of a preferred embodiment in connection with the drawing, showing:

only FIGURE a schematic view of a line connection with safety valve

DETAILED DESCRIPTION OF THE INVENTION

The FIGURE shows a consumer 1, which is connectable with a hydraulic supply 3 by way of a detachable supply connection 2. The hydraulic supply 3 can, for example, be a tractor, whose motor drives a hydraulic pump. The consumer 1 can be an agricultural equipment, which must be driven by the hydraulic oil from the pump of the tractor 3. This equipment is detachably connected with the tractor, in order to be exchangeable. Besides the mechanical connection, not shown in detail, also the hydraulic connection must be prepared for being detached and connected again. For this purpose, the supply connection 2 is provided. The supply connection 2 has a pressure connection P and a tank connection T, each ending in connection valves 4, 5. Corresponding connection valves 6, 7 are available on the supply 3. The connection valves 4 to 7 only open, when the connection is established. When the corresponding plugs or sockets are separated from each other, the individual lines are closed. The supply connection 2 is shown as one unit. However, it is also possible indeed that the pressure connection P and the tank connection T are led out of the consumer 1 in separate lines.

Between the supply connection 2 and the consumer 1 a safety valve 8 is arranged so that it can disconnect a pressure carrying line between the supply connection 2 and the consumer 1.

The safety valve 8 has a slide 9, which can be axially displaced in a housing 11 against the force of a spring 10.

The housing 11 has a bore 12, which has three different diameters in the axial direction, that is, in the movement direction of the slide. An annular chamber 13, which has a larger diameter than the slide 9, lies next to a lower area in which the spring 10 is arranged and which has the same diameter as the slide 9. Next to the annular chamber 13 is a bore section 14 with a reduced diameter. Between the annular chamber 13 and the bore section 14 is a circumferential edge 15, which forms a valve seat.

The slide goes from its largest diameter, which corresponds to the lower section of the bore 12, via a bevelling 16 into a front side 17, which is arranged in the bore section 14.

The section of the bore 12, in which the spring 10 is arranged, and which in the following is called spring chamber 30, is directly connected with the connection valve 5 at tank connection T via a line 18. In this connection, the expression "directly" means that a flow of fluid from the spring chamber to the connection valve 5 at tank connection T is unpreventedly possible, when a corresponding pressure difference is available. As will be explained later, the availability of valves, for example non-return valves, is in this connection harmless.

A throttle 29 is arranged in the slide, which throttle connects the annular chamber 13 with the spring chamber 30. This throttle 29 is arranged so that it is closed by the housing 11 on a small movement of the slide 9 into the spring chamber 30.

The annular chamber 13 is connected with the connection valve 4 at the pump connection P. The bore section 14 is connected with the consumer via a line 19. The consumer has an inlet module 20, which maintains a pressure difference between its pump connection P' and its tank connection T', when such a pressure difference. has once been produced. Schematically, this is arranged through a valve 21. Besides, the consumer 1 has one or more proportional valves 22, via which the inlets A, B, A', B' can be supplied. The tank connection T' of the consumer is connected with the line 18 of safety valve 8 via a non-return valve 23.

Between the supply connection 2 and the safety valve 8, or the non-return valve 23, respectively, a valve bridge 24 is arranged, which has four non-return valves 25 to 28. The non-return valves 25 to 28 are connected after each other in pairs, the non-return valves 25, 26 being arranged in one branch and opening in the same direction, the non-return valves 27, 28 being arranged in another branch, also opening in the same direction. The inlets of the non-return valves 25, 27 are connected with each other and with the line 18. The outlets of non-return valves 26, 28 are connected with each other and with the annular chamber 13. The middle outlet between the non-return valves 25, 26 is connected with the connection valve 4 of the pump connection P. The middle outlet between the non-return valves 27, 28 is connected with the connection valve 5 of the tank connection T.

The device now works as follows:

When the connection is realised as shown, no pressure acts upon the pump connection P. Accordingly, the spring 10 presses the slide 9 into the position shown. The consumer 1 receives no pressure. There is no risk of damages due to a too high pressure.

In the normal function, both the P-connection and the T-connection are connected correctly. The connection valves 4, 6 and 5, 7, respectively, are open and permit the flow of hydraulic fluid from the supply 3 in the direction of the consumer 1 and vice versa. Initially, the valve bridge 24 is not taken into consideration. The pressure in the annular chamber 13 now acts upon the slide 9 in the opening direction. As the spring chamber 30 over the line 18 is pressure released, the pressure in the ring chamber 13 is sufficient to overcome the counter power of the spring 10. The slide is thus pushed in the direction of the lower end of the housing 11. As soon as the slide lifts off from the edge 15, the hydraulic fluid also reaches the front side 17, causing the slide to be opened even farther or even faster, respectively. The hydraulic fluid can now reach the connection P' of the consumer 1 via the line 19. The inlet module 20 now produces a counter pressure, that is a pressure difference between the connections P', T', which is higher than the pressure required to keep the safety valve 8 open. Thus, the safety valve 8 remains open until the pump in the supply 3 is turned off, or the connection between the connection valves 4, 6 is disconnected.

When the safety valve 8 is open, the housing 11 closes the throttle 29, so that here a leakage cannot occur.

In connection with a malfunction, for example the connection of the connection valves 4, 6 has been made correctly. For some reason, however, the tank connection, that is, the connection of the connection valves 5, 7 is wrong. Accordingly, the pressure in the spring chamber 30 over the line 18 cannot be reduced. On the contrary, the pump pressure propagates through the throttle 29 into the spring chamber 30, thus securing that the valve does not open. The same pressure is acting upon both sides of the slide 9. The pressure-applying surface in the opening direction, however, is smaller than the one in the closing direction. Additionally, the spring 10 acts in the closing direction. Accordingly, no pressure can reach the consumer 1, thus overloading it.

The valve bridge 24 serves as protection against an exchange of the connections. When the connection valves 4, 6 and 5, 7, respectively, are connected correctly, the pressure over the non-return valve 26 gets into the annular chamber 13 and from the line 18 via the non-return valve 27 back to the tank connection T. When the connection valves are connected reversedly, that is, connection valve 4 with connection valve 7 and connection valve 5 with connection valve 6, then the pressure reaches the annular chamber 13 via the non-return valve 28 and from the line 18 via the non-return valve 25 back to the supply. Thus, a damaging of components caused by a wrong pressure application can be successfully prevented.

The valve bridge 24 barely produces a small pressure decrease. Thus, it can still be assumed that the line 18 is directly connected with the one of the connection valves 4, 5, which is connected with the corresponding tank connection 7 of the supply 3.

What is claimed is:

1. A detachable hydraulic line connection with a supply connection having a pressure line and a return line, each ending at a connection valve, and with a safety valve in a line between the pressure line and a consumer, said safety valve having a valve element, whose one side is acted upon by a pressure at a pressure connection with a purpose of opening the safety valve, and whose other side is directly connected with the return line.

2. Connection according to claim 1, wherein a throttle is provided between the pressure line and the return line.

3. Connection according to claim 10, wherein a throttle is arranged in the valve element.

4. Connection according to claim 3, wherein the throttle is closed when the valve element is in an open position.

5. Connection according to claim 1, wherein the valve element is made in the shape of a slide.

6. Connection according to claim 1, wherein a surface area of the valve element acted upon by pressure in an opening direction increases as the valve is opened.

7. Connection according to claim 6, wherein the consumer produces a counter pressure, which is larger than the pressure required to open the safety valve.

8. Connection according to claim 7, wherein the consumer has an inlet module, which produces the counter pressure.

9. Connection according to claim 1, wherein a consumer connection has a valve bridge, which is formed by two pairs of non-return valves, opening in the same direction and being arranged in series between the pressure line and the return line, the middle outlets of each pair being connected with a connection valve.

* * * * *